US008882457B2

(12) United States Patent
Bosen

(10) Patent No.: US 8,882,457 B2
(45) Date of Patent: Nov. 11, 2014

(54) MULTISTAGE RADIAL TURBOCOMPRESSOR

(75) Inventor: Werner Bosen, Cologne (DE)

(73) Assignee: Atlas Copco Energas GmbH, Cologne (DE)

( * ) Notice: Subject to any disclaimer, the term of this patent is extended or adjusted under 35 U.S.C. 154(b) by 1197 days.

(21) Appl. No.: 12/615,627

(22) Filed: Nov. 10, 2009

(65) Prior Publication Data

US 2010/0124491 A1 May 20, 2010

(30) Foreign Application Priority Data

Nov. 14, 2008 (DE) ..... 10 2008 057 472

(51) Int. Cl.

| | |
|---|---|
| ***F04D 17/12*** | (2006.01) |
| ***F04D 29/056*** | (2006.01) |
| ***F04D 29/058*** | (2006.01) |
| ***F04D 29/051*** | (2006.01) |

(52) U.S. Cl.

CPC ..... *F04D 29/058* (2013.01); *F04D 29/051* (2013.01); *F04D 17/122* (2013.01)

USPC ..... 415/198.1; 416/198 A; 416/201 R

(58) Field of Classification Search

USPC ..... 415/182.1, 198.1; 416/201 R, 198 A

See application file for complete search history.

(56) References Cited

U.S. PATENT DOCUMENTS

| | | | | |
|---|---|---|---|---|
| 681,581 | A * | 8/1901 | Richards | 415/104 |
| 5,795,138 | A | 8/1998 | Gozdawa | |
| 7,871,239 | B2 * | 1/2011 | Sorokes | 415/116 |
| 8,597,001 | B2 * | 12/2013 | Saari et al. | 417/423.8 |

FOREIGN PATENT DOCUMENTS

| | | | |
|---|---|---|---|
| JP | 2000046000 | A * | 2/2000 |
| JP | 2000291597 | A * | 10/2000 |
| JP | 2003269390 | A * | 9/2003 |
| WO | WO 9524563 | A1 * | 9/1995 |

OTHER PUBLICATIONS

Translation of JP 2000-046000A provided by Patent & Utility Model Gazette.*

Translation of JP 2003-269390A provided by Patent & Utility Model Gazette.*

Translation of JP 2000-291597A provided by Espacenet.*

* cited by examiner

*Primary Examiner* — Richard Edgar
*Assistant Examiner* — Justine Seabe
(74) *Attorney, Agent, or Firm* — Andrew Wilford

(57) ABSTRACT

A multistage radial turbocompressor has at least first, second, and third intake parts each forming a respective intake spaced along an axis and first, second, and third output parts each forming a respective output axially juxtaposed with the respective intakes. Respective first, second, and third fans having axially directed vanes are rotatable in the housing formed by the parts between the intakes and outputs. A shaft centered on the axis carries the first, second, and third fans. One of the fans is back-to-back with another of the fans with the vanes of the one fan facing axially oppositely away from the vanes of the other of the fans. Radial bearings support the shaft in the housing, and an axial bearing between the one fan and the other fan supports the shaft in the housing.

11 Claims, 1 Drawing Sheet

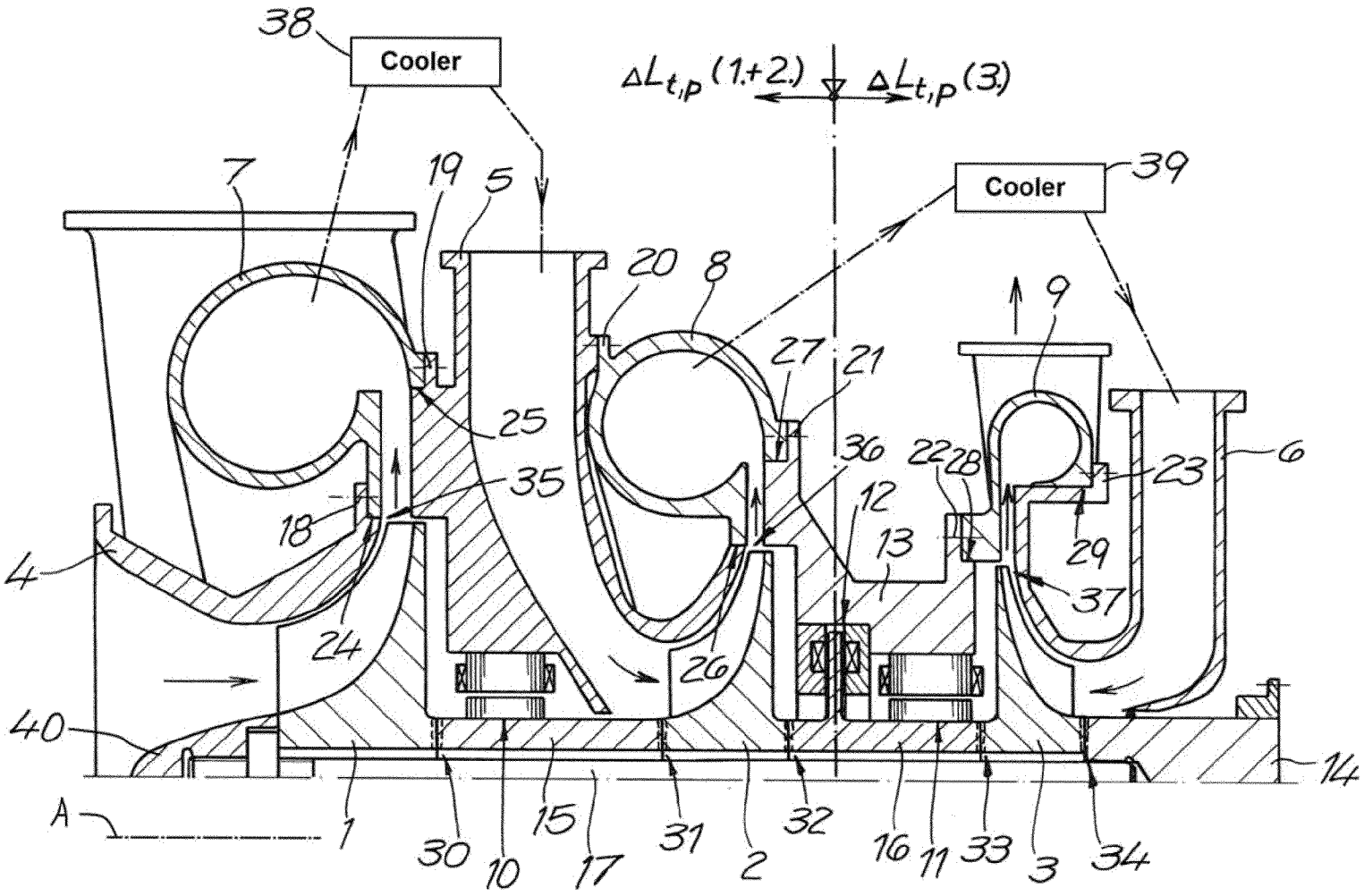
Cooler
Cooler
$\Delta L_{t,p}$ (1.+2.)
$\Delta L_{t,p}$ (3)
A

MULTISTAGE RADIAL TURBOCOMPRESSOR

FIELD OF THE INVENTION

The present invention relates to a turbocompressor. More particularly this invention concerns a multistage turbocompressor having at least three stages.

BACKGROUND OF THE INVENTION

A turbocompressor typically has at least three compressor stages each in turn having a housing part forming a io respective gas intake and a housing part forming a respective gas output. Each stage further has a respective impeller or fan carried on a common shaft structure to form a rotor supported by radial and axial bearings in the housing parts forming the intakes and outputs.

In radial turbocompressors, the gas flows axially into the impeller of the first stage. It is collected in the impeller intake and diverted radially and accelerated by its vanes. The gas leaves the impeller chambers at great velocity at the impeller circumference and flows into an expanding, radial diffusor. Here its speed is sharply reduced. The kinetic energy is converted to pressure. Finally the gas that has been compressed and heated in this manner is conducted in a spiral collection housing to an output connector.

High pressures can be produced by providing a plurality of impellers in succession along a drive shaft. The impellers are operated at the same speed. Together with the shafts they form a rotor having a common mount and drive. The radial bearings for such single-shaft radial turbocompressors are generally arranged on the shaft ends. The axial bearing is also positioned on a shaft end so that the rotor can move only io axially.

The housing of such turbocompressors is either divided axially or has an integrated outer housing cover. In an axially divided embodiment, the rotor is enclosed by a lower housing half and an upper housing half. In order to make the rotor accessible, the entire upper housing part must be removed. The upper and lower housing halves are each cast or welded in a single piece. In another embodiment, the housing has an integral cylindrical outer housing shell that is cast or welded and parts, such as for instance intakes and outputs for the individual compressor stages, are each divided axially so that they can be mounted between the impellers.

After cooling and passing through some ducts, the gas compressed in the first impeller is conducted to the second impeller and from there, after further cooling, to the next impeller. The goal is to bring the multistage gas compression as close as possible to the ideal, isothermic compression process.

In multistage turbocompressors, hot and cold housing parts are arranged successively in a fixed relationship. Since the cold and hot housing parts are always securely mounted to, welded to, or cast with one another, there is internal stress in the housing due to the thermal expansion. The different temperatures of the individual housing parts cause different amounts of thermal expansion for the parts. There may also be pressure deformations in the housing parts.

During operation, the arrangement of the bearings on the shaft ends and the axial division of the housing with housing parts that are securely joined to one another or the internal housing parts gripped in a common housing cover can lead to a reduction in the clearances between the impellers and the housing parts adjacent to them. This can lead to the impellers scraping against the housing and thus to damage to the turbocompressor.

OBJECTS OF THE INVENTION

It is therefore an object of the present invention to provide an improved multistage radial turbocompressor.

Another object is the provision of such an improved multistage radial turbocompressor that overcomes the above-given disadvantages, in particular designed so as to prevent the clearances between the impellers and the housing parts adjacent to them from becoming smaller during compressor operation.

SUMMARY OF THE INVENTION

A multistage radial turbocompressor has according to the invention at least first, second, and third intake parts each forming a respective intake spaced along an axis and respective first, second, and third output parts each forming a respective output spaced along the axis and axially juxtaposed with the respective intakes. The intake and output parts are fixed together to form a housing. Respective first, second, and third fans having respective axially directed vanes are rotatable in the housing about the axis between the respective first, second, and third intakes and outputs. A shaft centered on and rotatable about the axis is fixed rotationally to the first, second, and third fans. One of the fans is back-to-back with another of the fans with the vanes of the one fan facing axially oppositely away from the vanes of the other of the fans. The outputs of the one fan and other fan are axially juxtaposed with no intake between them. Radial bearings support the shaft in the housing, and an axial bearing between the one fan and the other fan supports the shaft in the housing.

The positioning of two impellers with their backs facing one another is also called the back-to-back principle. The effect of the central arrangement of the axial bearing between two impellers arranged back-to-back is that the changes in length caused by thermal expansion and pressure deformations in the housing parts enlarges the clearances between the impellers and the housing walls adjacent them so that the impellers do not touch them.

In a three-stage turbocompressor, the axial bearing is preferably arranged in a central position between the second and third stage, the second and third stage being positioned back-to-back. The impeller for the second stage, or, depending on the arrangement of the stages, the impeller for the third stage, is in series with the impeller for the first stage. The three impellers, two shaft ends, and two intermediate shafts are preferably centered relative to one another via end-face teeth and are locked axially together by a central tension rod to create a rigid rotor assembly.

In a four-stage compressor, the rotor comprises the four impellers, the two shaft ends, and three intermediate shafts. The additional impeller, together with its intake and output, forms the fourth compressor stage, which is preferably arranged back-to-back with the first stage.

In one advantageous embodiment of the invention the radial bearings are mounted on shaft parts that are each provided between two respective impellers.

It has proven particularly advantageous when the radial bearing near a connector part connecting the output parts of the one and other fan is arranged between the impeller closest to the coupling and the adjacent impeller so that the impeller on the coupling side and the shaft end on the coupling side project freely.

In a three-stage turbocompressor what this leads to is that the impeller for the third stage, or, depending on how the stages are arranged, the impeller for the second stage, and the shaft end on the coupling side are arranged projecting freely. In a four-stage radial turbocompressor the radial bearing on the coupling side is positioned between the third stage and the fourth stage. The impeller for the fourth stage, or, depending on how the stages are arranged, the impeller for the third stage, and the shaft end on the coupling side project freely.

In another advantageous embodiment of the invention, the radial bearing that is remote from the connector part is mounted on the shaft between the first impeller and the adjacent impeller. The radial bearing is positioned behind the projecting impeller for the first stage, there being no free shaft end on the side opposing the connector part. This has the advantage that the intake for the first stage can be made as a simple, nondeflecting coaxial intake connector.

Preferably undivided magnetic radial and axial bearings are used. Magnetic bearings offer significant technical advantages thanks to their active regulation of stiffness and damping. They are also characterized by very low friction losses.

It has proven particularly advantageous when the housing is segmented transversely of the axis, that is on planes perpendicular to the axis, into cold and hot housing parts. The housing parts for the gas intakes and the gas outputs each form independent, undivided housing parts. These annularly surround the rotor without axial division, that is are not axially split and are annularly continuous.

In one preferred embodiment of the invention, the intake for the first stage comprises a simple deflection-free coaxial intake connector. The intakes for all of the subsequent stages are radial intake connectors. The outputs for the compressor stages can be spiral collection chambers. The tangential output connectors for the hot outputs are connected to the intake connectors for the coolers via ducts. The output connectors for the coolers are connected to the radial intake connectors for the next compressor stage via wide low-loss flow channels.

In one particularly preferred embodiment of the invention, adjacent housing parts are joined to one another via transverse flange connections. The adjacent housing walls, at the connecting points, run transversely to the shaft and parallel to one another. The contact area at which the housing walls run transverse to one another is embodied annular about the rotor, the housing walls being joined to one another by fastening elements, for instance screws, at a plurality of locations on the circumferential ring. Internal stresses in the housing due to heat and pressure expansion can be reduced by dividing the housing into parts, typically of cast metal, e.g. an aluminum alloy, that can be joined to one another via transverse flange connections.

Furthermore, it is advantageous when adjacent housing parts interlock at their connecting points and their dimensions at the joints are matched to one another such that the housing parts are joined to one another via press fits.

BRIEF DESCRIPTION OF THE DRAWING

The above and other objects, features, and advantages will become more readily apparent from the following description, reference being made to the accompanying drawing whose sole FIGURE is a partly diagrammatic axial section through the turbocompressor according to the invention.

SPECIFIC DESCRIPTION

As seen in the drawing three axial-input radial output impellers or fans 1, 2, and 3 are spaced along an axis A and each constitute a stage of a three-stage compressor. Two tubular stub shafts 15 and 16 are provided between the impellers 1, 2, and 3 and end parts 14 and 40 secured together by an axially centered tension shaft or rod 17 to lock the parts 40, 1, 15, 2, 16, 3, and 14 together. Teeth 30 and 31 between ends of the shaft 15 and the parts 1 and 2, teeth 32 and 33 between ends of the shaft 16 and the parts 2 and 3, and teeth 34 between the impeller 3 and the end part 14 lock the assembly together angularly for joint rotation. A drive may be connected to the rear-end part 14 to turn the rotor formed by the parts 1, 2, 3, 14, 15, 16, 17, and 40 about the axis A.

The three compressor stages with the respective fans 1, 1, 2, and 3 have respective cold intakes 4, 5, and 6 and respective hot outputs 7, 8, and 9. The gas to be compressed enters axially at the intake 4 and flows radially through the impeller 1 to be expelled tangentially at the spiral output 7. Thence it flows through a first intermediate cooler 38 to the second intake 5 that feeds it axially to the second impeller 2 from which it expelled through the output 8 to a second intermediate cooler 39. This cooler 39 shunts the twice-compressed gas to the third intake 6 of the axial-input radial-output final third fan 3 that in turn expels it at the output 9. The connecting ducts between the outputs 7 and 8 and the intakes 5 and 6 is designed, like the coolers 38 and 39, for minimal loss and flow obstruction.

The impellers 2 and 3 are positioned back to back, that is with their vanes facing away from each other. The center shaft 16 runs between them. The outputs 8 and 9 for the second and third stages are joined to one another via an intermediate housing or connector part 13 that is bolted with the castings forming the intakes 4, 5, and 6 and outputs 7, 8, and 9 to form an integral housing. In accordance with the invention, an axial bearing 12 is provided between the back-to-back impellers 2 and 3 on the connector part 13 and shaft 16. A radial bearing 11 close to the axial bearing 12 is also mounted between the part 13 and shaft 16. Another radial bearing 10 is provided between the output 5 and the shaft 17 so that the fan 1 and front-end part 14 are cantilevered at the front end of the compressor and the fan 3 and end part 14 at its rear end.

These bearings 10, 11, and 12, which are all magnetic bearings, compensate for changes in length $\Delta L_{t,p}$ (1.+2.) and $\Delta_{lt,p}$ (3.) of the compressor stages of the fans 1, 2, and 3 caused by thermal expansion and pressure deformation in the housing parts 4 through 9 increase clearances 35, 36, and 37 between the impellers 1, 2, and 3 and their adjacent intakes 4, 5, and 6. This prevents the impellers 1, 2, and 3 from brushing against their adjacent intakes 4, 5, and 6.

The intake 4 for the first compressor stage projects a bit into the output 7 for this first compressor stage. The dimensions of the two housings 4 and 7 are matched to one another at the connection such that a press fit is created at complementary surfaces between the two housing parts forming the intake 4 and output 7. More particularly, these two housing parts have annular and planar contact faces 18 that engage each other axially and cylindrical contact faces 24 that engage each other radially so that they are fixed axially and radially relative to each other.

The intake 5 for the second stage projects into the output 7 for the first stage at a connection between the first compressor stage and the second compressor stage. The dimensions of the two housing parts forming the intake 5 and output 7 are matched to one another such that a press fit is created between annular and planar faces 19 that engage each other axially and cylindrical and concentric cylindrical surfaces 25 that engage each other radially, again radially and axially fixing these parts 5 and 7 together.

Similarly the part forming the intake 5 fits complementarily with the part forming the output. To this end planar annular surfaces 20 engage each other axially and cylindrical concentric surfaces 26 engage each other radially, ensuring that the parts 5 and 8 cannot move radially or axially relative to each other. The output part 8 in turn is joined to the connector at a press fit formed by planar and annular faces 21 that engage each other axially and cylindrical and concentric surfaces 27 that engage each other radially.

The parts forming the intake 6 and output 9 of the third stage with the fan 3 are similarly mounted. More particularly planar and annular faces 22 engage each other axially and cylindrical and concentric inner and outer surfaces 28 engage each other radially between the connector part 13 and the output 9. This output 9 in turn is coupled at planar and annular faces 23 that engage each other axially and cylindrical and concentric surfaces 29 that engage each other radially to the intake 6 that is thus wholly supported via the output part 9 on the connector 13.

Thus all the cold intakes 4, 5, and 6 and the connector part 13 with the hot outputs 7, 8, and 9 are joined to one another as undivided housing parts via axially engaging planar faces 18, 19, 20, 21, 22, and 23 and radially engaging cylindrical surfaces 24 25, 26, 27, 28, and 29. What this leads to is that during operation thermal internal stresses in the housing unit are largely prevented and thus deformations of the housing that occur during operation are minimized.

I claim:

1. A multistage radial turbocompressor comprising:

first, second, and third fans spaced along an axis, having respective axially directed vanes, and rotatable about the axis;

an intermediate shaft part centered on and rotatable about the axis and forming with the first, second, and third fans a rotor rotatable about the axis, the intermediate shaft part being fixed rotationally between the second and third fans, the second fan being back-to-back with the third fan with the vanes of the second fan facing axially oppositely away from the vanes of the third fan and outputs of the second fan and the third fan being axially juxtaposed with no intake part between them;

first, second, and third separate intake parts juxtaposed with the respective fans and forming respective first, second, and third intakes spaced along the axis;

respective first, second, and third separate output parts axially juxtaposed and connected with the respective intake parts and forming respective first, second, and third spiral outputs spaced along the axis, the intake and output parts each being undivided and independent, the first output part being connected to the second intake part;

a connector part connected between the second and third output parts, the intake and output parts and connector part together forming an axially extending housing surrounding the rotor;

a first cooler connected between the first output part and the second intake part;

a second cooler connected between the second output part and the third intake part;

a plurality of radial bearings supporting the shaft in the housing;

an axial bearing and one of the radial bearings on the intermediate shaft between the back-to-back second and third fans, between the intermediate shaft part and the connector part, and supporting the intermediate shaft part in the housing; and a drive connected to an end of the rotor to rotate the rotor about the axis.

2. The multistage turbocompressor defined in claim 1, further comprising:

another intermediate shaft part between the first and second fans and between the second and third fan, the radial bearings being on the shaft parts.

3. The multistage turbocompressor defined in claim 2 wherein the axial bearing is between the radial bearings.

4. The multistage turbocompressor defined in claim 1 wherein one of the radial bearings is between the second fan and the third fan.

5. The multistage turbocompressor defined in claim 1 wherein the radial bearings are axially inward of the first and third fans.

6. The multistage turbocompressor defined in claim 1 wherein the bearings are magnetic bearings.

7. The multistage turbocompressor defined in claim 1 wherein each intake part is are fitted to the respective output part at complementary faces inhibiting relative radial and axial movement.

8. The multistage turbocompressor defined in claim 7 wherein the faces of each part include at least one planar and annular face that is directed axially and at least one cylindrical surface that is centered on the axis and directed radially.

9. The multistage turbocompressor defined in claim 8 wherein at least some of the planar faces extend from the respective cylindrical surfaces.

10. The multistage turbocompressor defined in claim 1 wherein each of the fans is an axial-input radial-output fan.

11. A multistage radial turbocompressor comprising:

at least three fans spaced along an axis, having respective axially directed vanes, and rotatable about the axis;

an intermediate shaft part centered on and rotatable about the axis and forming with the fans a rotor rotatable about the axis, the intermediate shaft part being fixed rotationally between the two of the fans, the two fans being back-to-back with the vanes of the two fans facing axially oppositely away one another and outputs of the two fans being axially juxtaposed with no intake part between them;

at least three separate intake parts juxtaposed with the respective fans and forming respective intakes spaced along the axis;

at least three respective separate output parts axially juxtaposed and connected with the respective intake parts and forming respective spiral outputs spaced along the axis, the intake and output parts each being undivided and independent, one of the output parts being connected to the adjacent intake part;

a connector part connected between the output parts of the two fans, the intake and output parts and connector part together forming an axially extending housing surrounding the rotor;

a first cooler connected between the one of the output part and one of the intake parts;

a second cooler connected between the another of the output parts and the another of the intake parts;

a plurality of radial bearings supporting the shaft in the housing;

an axial bearing and one of the radial bearings on the intermediate shaft between the two back-to-back fans, between the intermediate shaft part and the connector part, and supporting the intermediate shaft part in the housing.

* * * * *